US008134428B2

(12) United States Patent
Watford et al.

(10) Patent No.: US 8,134,428 B2
(45) Date of Patent: Mar. 13, 2012

(54) CIRCUIT BREAKER WITH ELECTRONIC SENSING AND DE-LATCH ACTIVATION

(75) Inventors: Russell T. Watford, Lawrenceville, GA (US); Kevin Miller, Duluth, GA (US)

(73) Assignee: Siemens Industry, Inc., Alpharetta, GA (US)

( * ) Notice: Subject to any disclaimer, the term of this patent is extended or adjusted under 35 U.S.C. 154(b) by 577 days.

(21) Appl. No.: 12/350,997

(22) Filed: Jan. 9, 2009

(65) Prior Publication Data

US 2009/0174508 A1 Jul. 9, 2009

Related U.S. Application Data

(60) Provisional application No. 61/019,974, filed on Jan. 9, 2008.

(51) Int. Cl.

| | |
|---|---|
| ***H01H 75/00*** | (2006.01) |
| ***H01H 73/12*** | (2006.01) |
| ***H01H 73/00*** | (2006.01) |
| ***H01H 83/06*** | (2006.01) |

(52) U.S. Cl. ..... 335/18; 335/2; 335/6; 335/7; 335/13; 335/15; 335/16; 335/21; 335/38; 335/106; 335/167; 335/170; 335/172; 335/173; 335/174; 335/185; 361/42

(58) Field of Classification Search ..... 335/1–2, 335/6–10, 13, 15–16, 18, 21–23, 34–38, 335/68, 99, 102, 106, 127–128, 132, 167–176, 335/185–186, 189, 202; 200/337; 361/42–50
See application file for complete search history.

(56) References Cited

U.S. PATENT DOCUMENTS

| | | | | | |
|---|---|---|---|---|---|
| 3,012,118 | A * | 12/1961 | Edmunds | 335/6 |
| 3,999,103 | A * | 12/1976 | Misencik et al. | 361/45 |
| 4,081,852 | A * | 3/1978 | Coley et al. | 361/45 |
| 4,641,217 | A * | 2/1987 | Morris et al. | 361/45 |
| 4,686,600 | A * | 8/1987 | Morris et al. | 361/45 |
| 5,260,676 | A * | 11/1993 | Patel et al. | 335/18 |
| 5,293,522 | A * | 3/1994 | Fello et al. | 335/18 |
| 5,453,723 | A * | 9/1995 | Fello et al. | 335/18 |
| 5,477,201 | A * | 12/1995 | Garnto et al. | 335/18 |
| 5,483,211 | A * | 1/1996 | Carrodus et al. | 335/18 |
| 5,552,755 | A * | 9/1996 | Fello et al. | 335/18 |
| 5,933,306 | A * | 8/1999 | Santos et al. | 361/45 |
| 6,255,923 | B1 * | 7/2001 | Mason et al. | 335/18 |
| 6,724,591 | B2 * | 4/2004 | Clarey et al. | 361/42 |
| 6,946,935 | B2 * | 9/2005 | Wu et al. | 335/18 |
| 2006/0097829 | A1 * | 5/2006 | McCoy | 335/6 |

* cited by examiner

*Primary Examiner* — Mohamad Musleh

(57) ABSTRACT

A circuit breaker and method includes a mechanical pole moveable between a latched position and an unlatched position to open an electrical connection between a pair of electrical contacts. An electronic tripping device is configured to respond to a sensor signal. The sensor signal is output from a condition sensor wherein upon receiving the sensor signal the electronic tripping device trips the mechanical pole into the unlatched position.

19 Claims, 11 Drawing Sheets

100

100

100

300

CIRCUIT BREAKER WITH ELECTRONIC SENSING AND DE-LATCH ACTIVATION

RELATED APPLICATION INFORMATION

This application claims priority to provisional application Ser. No. 61/019,974 filed on Jan. 9, 2008, incorporated herein by reference.

BACKGROUND

1. Technical Field

This disclosure relates to circuit breakers, and more particularly, to a circuit breaker with electronic sensing and de-latching.

2. Description of the Related Art

Residential circuit breakers have historically been designed with a bimetal and magnetic yoke assembly to mechanically detect when an overload or instantaneous condition exists. When either condition exists, an armature is rotated by bending of the bimetal and therefore de-latches or trips the mechanism, thus opening a circuit.

Typical residential circuit breakers include mechanical thermal and magnetic components that provide overload and instantaneous trip functions that protect circuits. Insulated molded housings are used to enclose and separate the mechanism poles from the electrical components. Mechanical tripping is used to trip the mechanism pole by rotating an armature connected to the overload and instantaneous systems. The armature is integrated into the design to provide de-latching and re-latching functions of the mechanism. The overall breaker size is standard so that the breaker plugs or bolts into two adjacent positions of a load center or panel board.

When an overload condition exists, a bimetal will deflect due to the increased temperature. This deflection in turn rotates an armature with a latching feature generating a latch bite that interfaces with a cradle. As the armature rotates, the latch bite decreases. Once the latch bite has decreased significantly, the cradle will slide past the armature and open the circuit.

In an instantaneous event, the breaker sees a surge in current. In turn, a magnetic field is generated in the current path bimetal. The yoke and armature use the magnetic forces generated to de-latch the breaker. This magnetic field will in turn pull the armature toward the yoke. As the armature rotates toward the yoke, the latch bite is decreased until the latch bite is small enough to allow the cradle to slide past and open the circuit.

The molded housings for a single pole circuit breaker basically include two split-half molded housings for one thermal/magnetic mechanism. The molded housing includes a single open compartment which houses all of the components. For example, the bottom of the open compartment is for the trip mechanism while an upper portion of the open compartment is for electrical components. When the mechanism pole is assembled, the open compartment is closed to connect electrical components attached to the mechanism pole. The molded housings for a two pole circuit breaker are basically two molded housings for each thermal/magnetic mechanism. Each mechanism would have a bimetal, yoke, and armature assembly. Either pole could trip the mechanism and in turn trip the adjacent pole by a rotating trip bar integrated into the design. The molded housing includes an open compartment. The bottom open compartment is for the mechanism while the upper open compartment is for electrical components. A center compartment houses components needed to provide the tripping functions. When the mechanism poles are assembled, the two mechanism compartments are assembled to each side of the center compartment.

Typically, a residential circuit breaker uses a mechanical overload and instantaneous protection mechanism that requires a bimetal, yoke, and armature assembly. The assembly process requires special attention to the amount of heat applied to the bimetal during assembly. In addition, time is required to thermally calibrate each circuit breaker.

The issues related to this assembly methodology include the following. A bimetal assembly process uses multiple brazing processes during the assembly. One braze operation is needed to assemble the yoke to the bimetal. A second brazing operation is needed to braze the bimetal to a load terminal, and a third brazing operation is needed to braze a conductive braid to the bimetal. Each of the three brazing operations can damage the bimetal's multi layer material. This also could result in inconsistencies in the final product. This design type is typically known as a directly heated bimetal since a current patch is brazed to the bimetal.

During calibration, an adjustment screw is used to reposition the bimetal and thermally calibrate the circuit breaker. This adjustment effects not only the latch engagement from breaker to breaker, but also the instantaneous trip times. The disadvantages with this type of assembly method and thermal calibration process include: the amount of time needed to fabricate the device, the uncertainty in producing thermal trip times that may be inconsistent between manufacturing plant and testing facility, and the potential damage due to multiple brazing steps.

SUMMARY OF THE INVENTION

A circuit breaker and method include a mechanical pole moveable between a latched position and an unlatched position to open an electrical connection between a pair of electrical contacts. An electronic tripping device is configured to respond to a sensor signal. The sensor signal is output from a condition sensor wherein upon receiving the sensor signal the electronic tripping device trips the mechanical pole into the unlatched position.

Another embodiment of the circuit breaker includes a mechanical pole moveable between a latched position and an unlatched position to open an electrical connection between a pair of electrical contacts. An actuator device is configured to respond to a sensor signal to actuate a plunger to release the mechanical pole to the unlatched position in accordance with a biasing device. At least one sensor is configured to monitor conditions of a circuit and to provide the sensor signal. A trip circuit is embodied in an integrated circuit and is responsive to the sensor signal when the conditions exceed a threshold wherein the trip circuit electronically generates a trip signal in accordance with the sensor signal exceeding the threshold to trip the mechanical pole into the unlatched position.

A method for breaking a circuit includes providing a circuit breaker having a mechanical pole moveable between a latched position and an unlatched position to open an electrical connection between a pair of electrical contacts, setting the circuit breaker to a latched position to provide a closed circuit loop through the circuit breaker, monitoring current in the closed circuit loop using an electronic circuit to determine when circuit conditions exceed at least one threshold value, and tripping the circuit breaker using an electronic signal generated by an integrated circuit chip when the circuit conditions exceed the at least one threshold value by causing the mechanical pole to move into the unlatched position.

These and other objects, features and advantages of the present invention will become apparent from the following detailed description of illustrative embodiments thereof, which is to be read in connection with the accompanying drawings.

BRIEF DESCRIPTION OF DRAWINGS

This disclosure will present in detail the following description of preferred embodiments with reference to the following figures wherein.

DETAILED DESCRIPTION OF PREFERRED EMBODIMENTS

Figure 1:
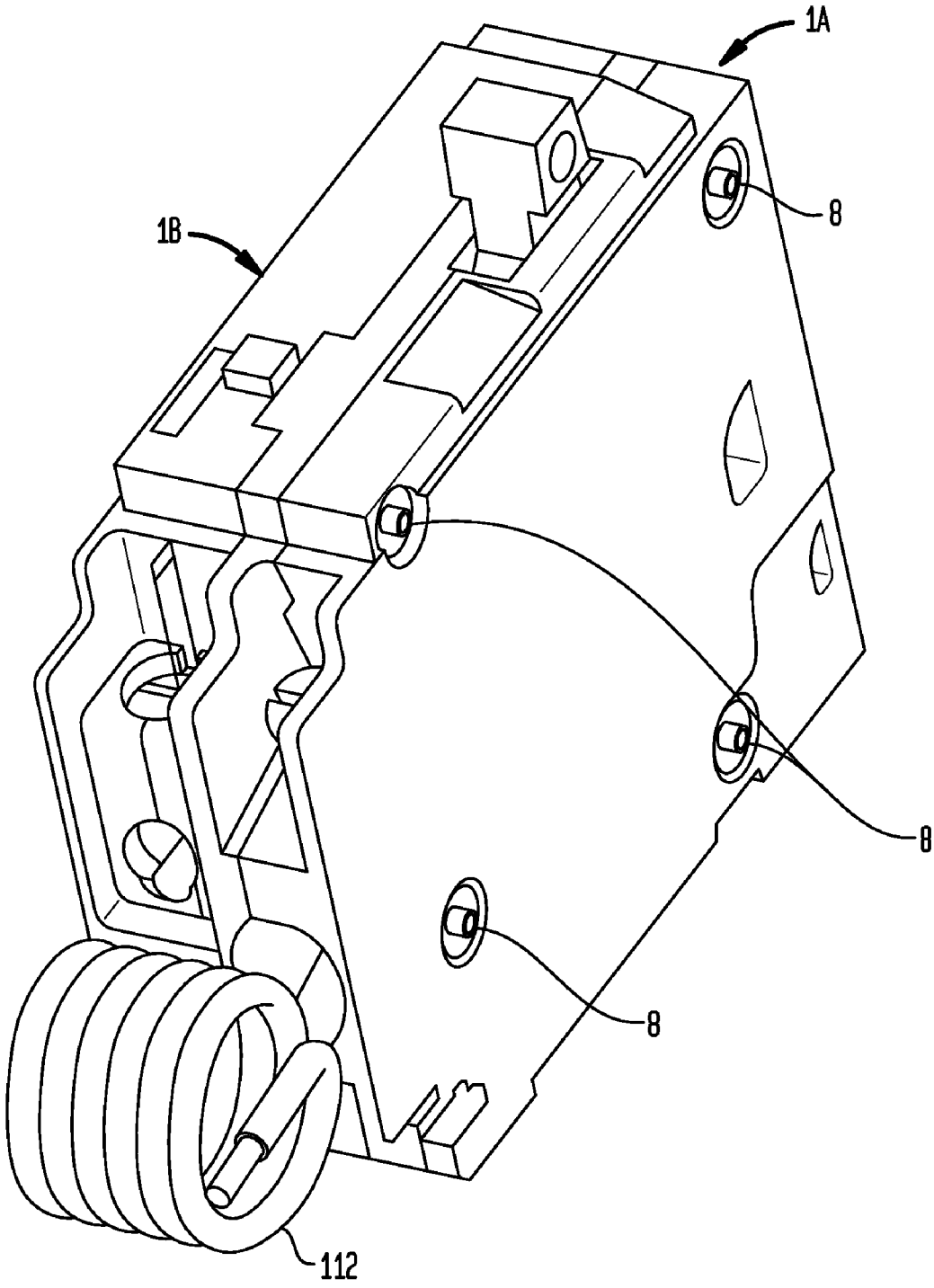
FIG. 1 is an isometric front view of a single pole residential circuit breaker in accordance with one embodiment.

The present invention provides devices and methods for a de-latching mechanism for circuit breakers. The present principles take full advantage of electronic circuitry to protect the circuit breaker from over-current loads and instantaneous conditions. The present principles provide an easier assembly method where a bimetal, a yoke, and an armature are replaced with a simpler design using less space in a mechanism pole in addition to improving a thermal calibration process.

In one embodiment, a residential circuit breaker includes a mechanism or mechanical pole with separate electrical contacts having an electronic tripping mechanism responsive to sense overload and instantaneous conditions (among other things). Two complete independent compartments, an electronic compartment and a mechanical compartment, may be provided for ease of produceability. In one embodiment, the mechanical and electronic compartments are subassembly modules that are separately constructed prior to final assembly.

The breaker may include a single pole or may include a two (or more) pole residential circuit breaker. The breaker may include a push to test button in the electronic compartment and independent of the mechanical compartment. The circuit breaker preferably eliminates brazing operations for manufacturing the breaker.

The present principles will be described in terms of a single pole circuit breaker employed for residential applications. However, the embodiments described are not limited to the illustrative example and may be employed in other configurations for other applications. For example, the present principles are equally applicable to two or more pole mechanisms, breakers that include push to test features, any size breakers, multiple breaker systems in a single housing, etc. The functions of the various elements shown in the figures can be provided through the use of dedicated hardware as well as hardware capable of executing software in association with appropriate software loaded on or in application specific integrated circuits (ASICs), processors or the like. When provided by a processor, the functions can be provided by a single dedicated processor, by a single shared processor, or by a plurality of individual processors, some of which can be shared. Moreover, explicit use of the term "processor" or "controller" should not be construed to refer exclusively to hardware capable of executing software, and can implicitly include, without limitation, digital signal processor ("DSP") hardware, read-only memory ("ROM") for storing software, random access memory ("RAM"), and non-volatile storage. Moreover, all statements herein reciting principles, aspects, and embodiments of the invention, as well as specific examples thereof, are intended to encompass both structural and functional equivalents thereof. Additionally, it is intended that such equivalents include both currently known equivalents as well as equivalents developed in the future (i.e., any elements developed that perform the same function, regardless of structure).

Thus, for example, it will be appreciated by those skilled in the art that the block diagrams presented herein represent conceptual views of illustrative system components and/or circuitry embodying the principles of the invention. Referring now in specific detail to the drawings in which like reference numerals identify similar or identical elements throughout the several views, and initially to FIG. 1, a single pole residential circuit breaker 100 is illustratively depicted in accordance with one embodiment. Breaker 100 includes two compartments formed in split-half housing sections 1A and 1B. The housing sections 1A and 1B are encased in a molded dielectric material and are preferable formed from a plastic material. The sections 1A and 1B are secured using one of more screws or rivets 8 (four are depicted). On connection wire 112 is depicted.

Figure 2A:
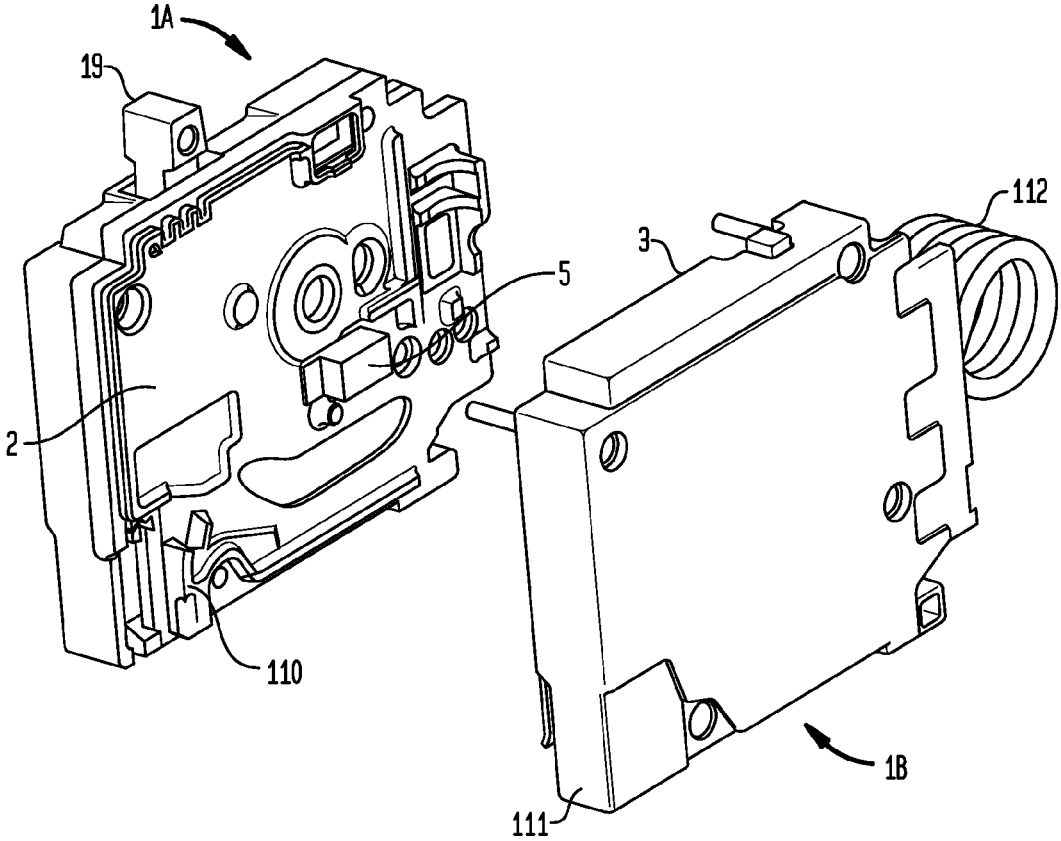
FIGS. 2A and 2B are opposing isometric exploded views of FIG. 1 showing separate compartments for mechanical components and electrical/electronic components.
Figure 2B:
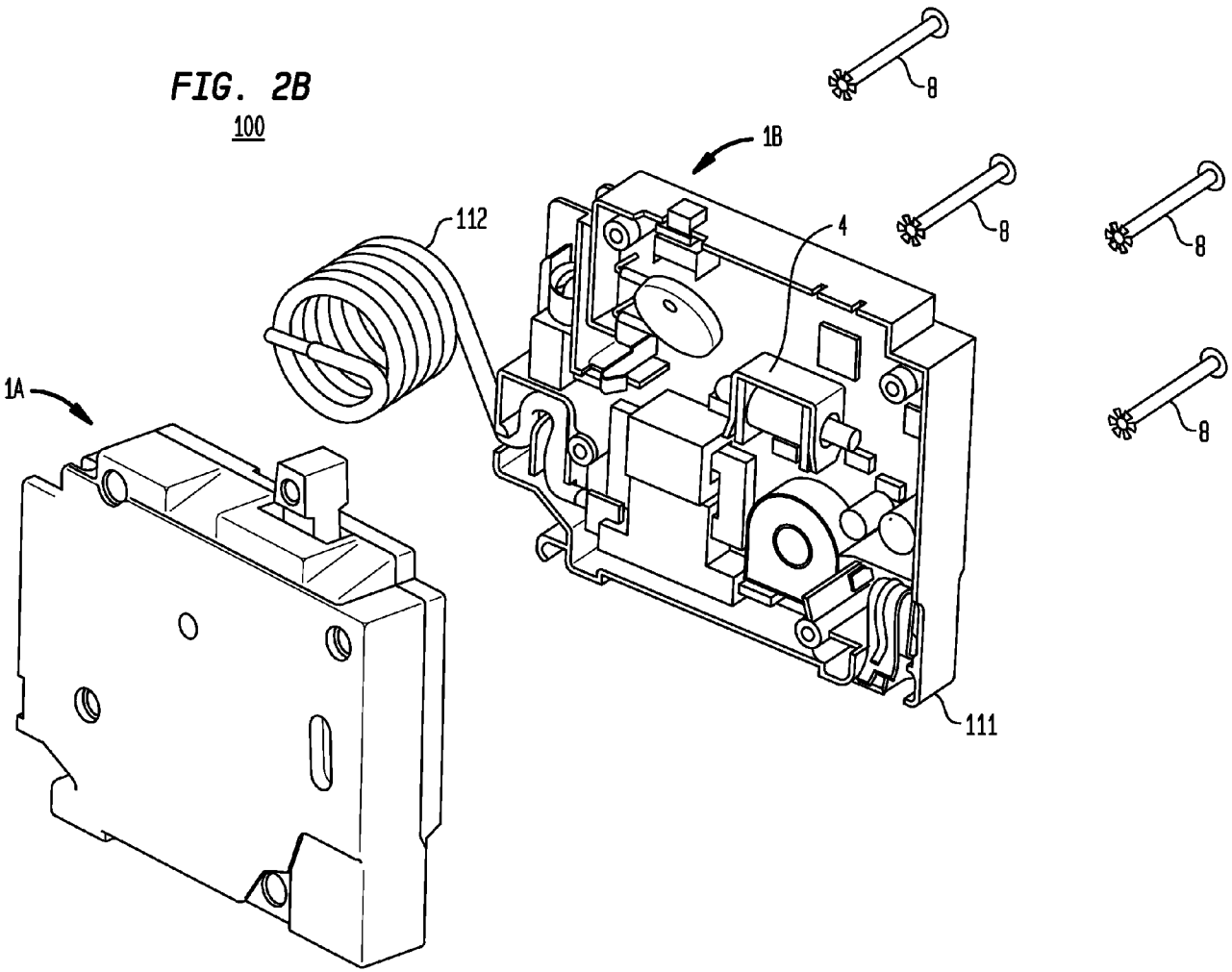

Referring to FIGS. 2A and 2B, an exploded view of breaker 100 reveals the inner portion of housing 1A in FIG. 2A and the inner portion of housing 1B in FIG. 2B. The housings 1A and 1B include internal compartments. Housing 1A includes a mechanical compartment 2 housing the mechanical components that are employed in causing the breaker to open or close. This includes a handle 19 and corresponding mechanisms for turning the breaker 100 on or off. An electronic compartment 3 includes electronic sensing devices and actuation devices for tripping the breaker 100.

In FIGS. 2A and 2B, the electronic compartment 3 is shown separated from the mechanical compartment 2. A molded cover 110 is preferably made of a thermal setting resin material with electrical insulating properties. The mechanical compartment 2 includes cover 110 to house and protect mechanical components. Compartment 2 is configured to permit a portion of a plunger 5 to extend therethrough so that operational contact can be made with a solenoid 4 in the electrical compartment when the housing 1A and 1B are finally assembled. In this example, the compartments 2 and 3 are held together with four rivets 8

The electronic compartment 3 is made up an outer top cover 111 that houses electronics. A solenoid 4 is located in the electronic compartment 3 and interfaces with a plunger 5 (see FIG. 6). A wire 112 is depicted which connects to one side of the breaker 100.

The two compartments 2 and 3 may be separately constructed and then brought together at final assembly. This permits flexibility in the fabrication process since electronics fabrication may be performed in and electronics fabrication facility while the mechanical components may be assembled at a machine shop or the like.

Figure 3:
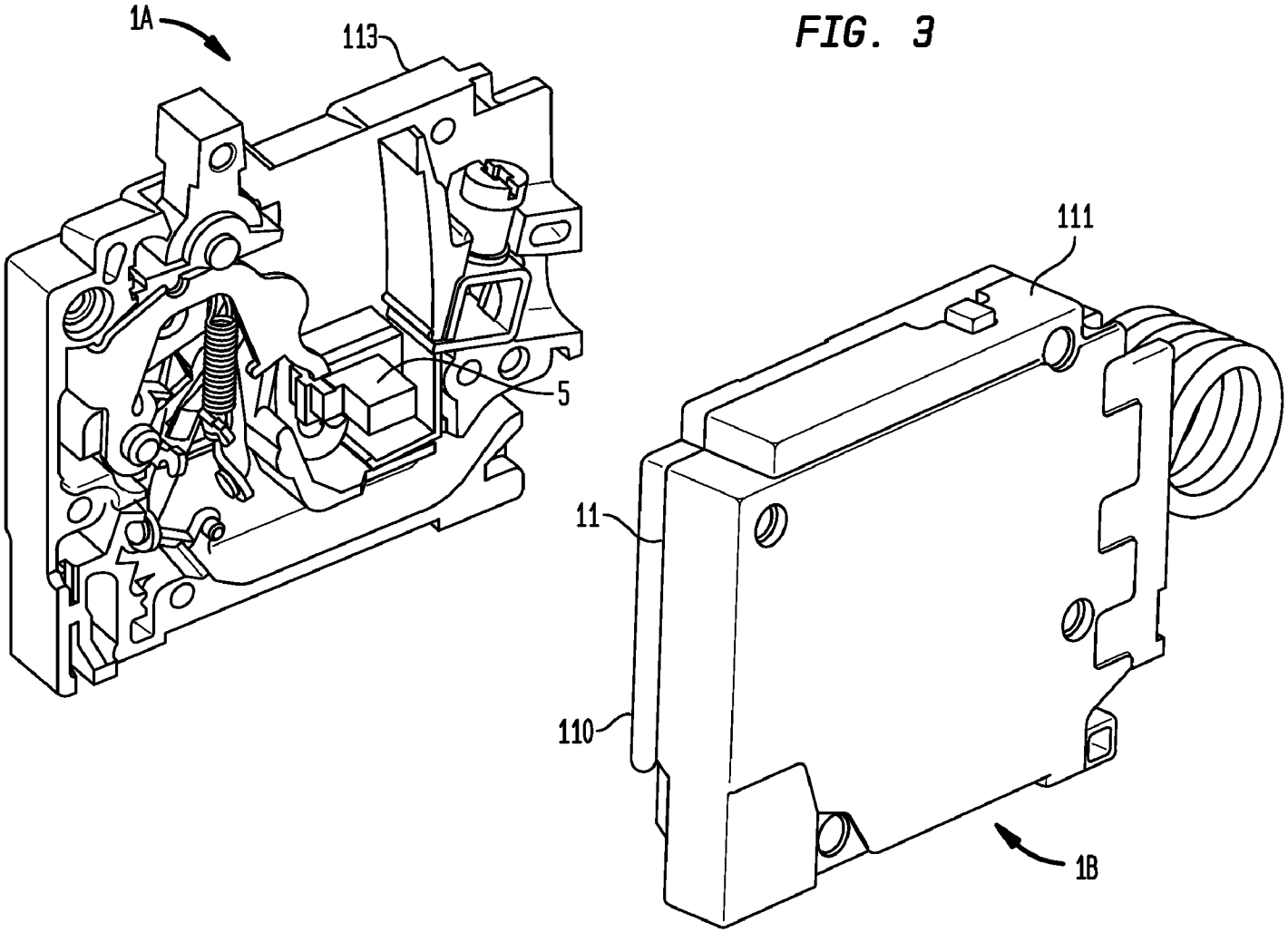
FIG. 3 is an isometric view that removes a mechanism pole cover to expose mechanical components of the de-latching mechanism from FIGS. 2A and 2B.
Figure 4:
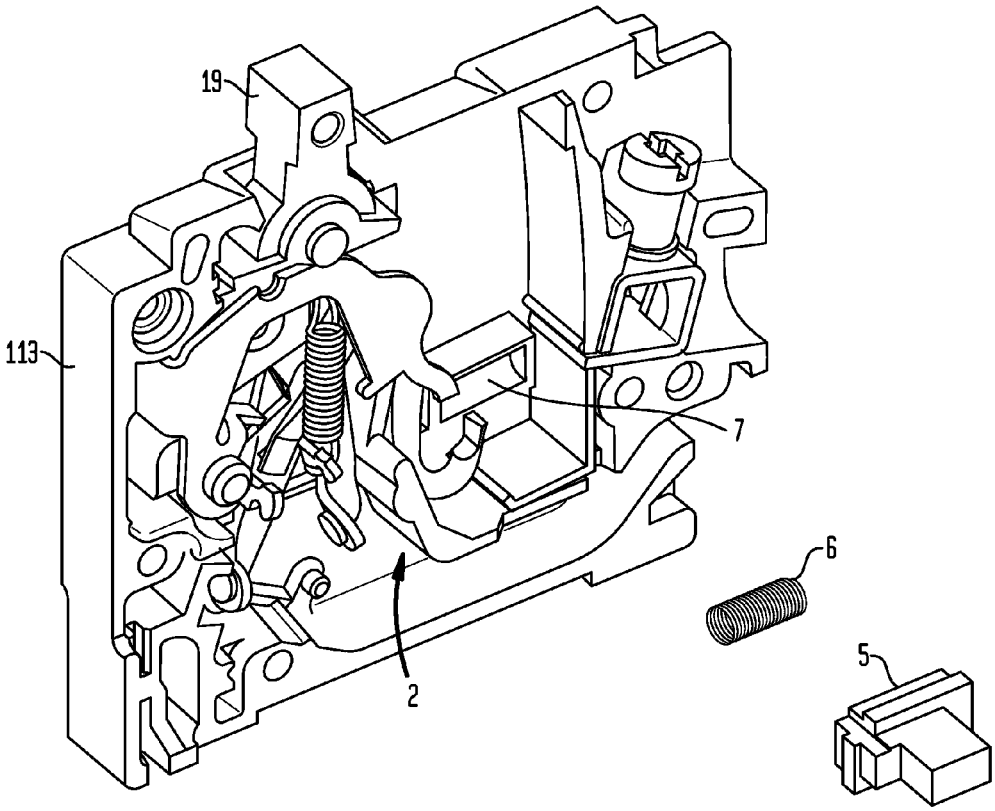
FIG. 4 is an isometric exploded view of the de-latching components shown in FIG. 3.

Referring to FIGS. 3 and 4, the plunger 5 is captured between an outer cover 113 and cover 110 of the mechanism compartment 2. An addition layer may be added at location 11 to protect the electronic compartment 3 as a separate subassembly. The plunger 5 is mounted in the compartment 2 in a housing 7. A spring 6 is used to reset the plunger 5 during normal operations. The plunger 5 interfaces with the solenoid 4 in the electronics compartment 3. This is an example of how electrical/electronic components are separated from mechanical components between the compartments 2 and 3. The parts of each compartment 2 and 3 correspondingly interface upon final assembly.

Figure 5A:
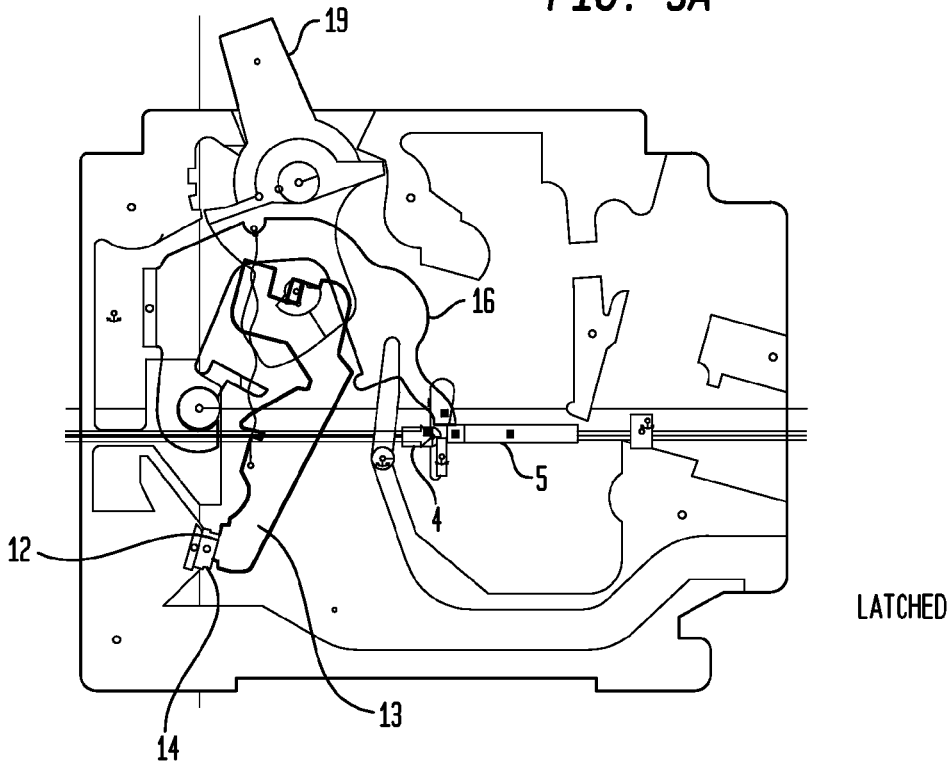
FIGS. 5A and 5B are 2D computer simulation views of a de-latching event where objects are shown in a latched position (FIG. 5A) and a de-latched position (FIG. 5B)
Figure 5B:
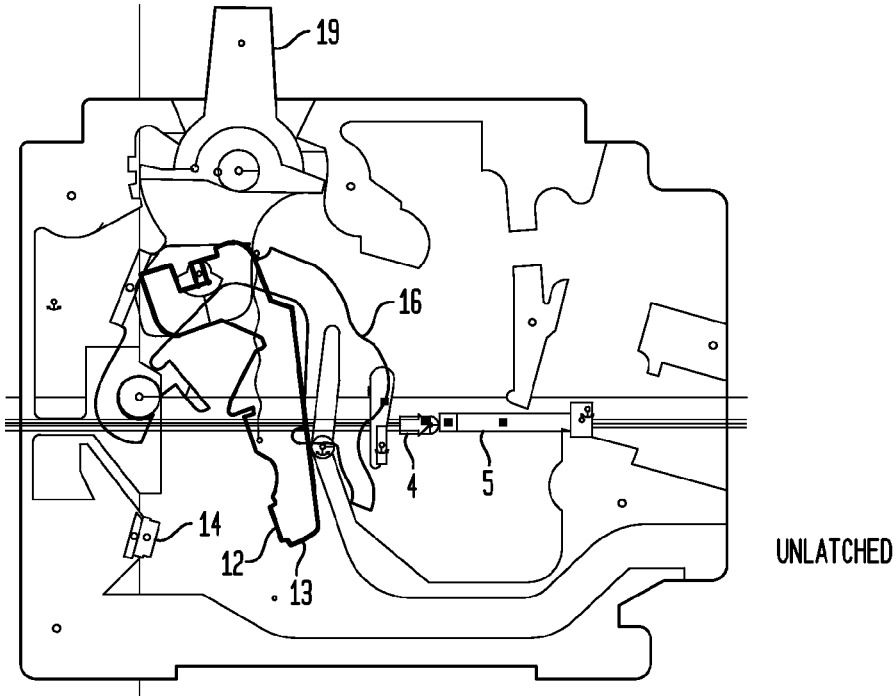

Referring to FIG. 5A, a two-dimensional model simulation shows a connection being made in a latched position of a conductor or pole 13. The conductor pole 13 connects at contacts 12 and 14 in the latched position. A conductive path is provided through the contacts 12 and 14 and back through to a wire connection (not shown). Plunger 5 is connected with a cradle 16, which holds pole 13 in contact with contact 14. A solenoid 4 is depicted as a force arrow in the simulation. When in the latched position as depicted in FIG. 5A, a closed circuit is provided where current flows through the breaker. Referring to FIG. 5B, a two-dimensional model simulation shows a connection being broken in an unlatched position of the conductor pole 13. The connection breaks between contacts 12 and 14 as a result of the plunger 5 being retracted by solenoid 4. This releases the cradle 16 and causes the conductive path to be opened between the contacts 12 and 14 by retracting pole 13. When in the unlatched position as depicted in FIG. 5B, an open circuit is provided where current does not flow through the breaker.

Figure 6:
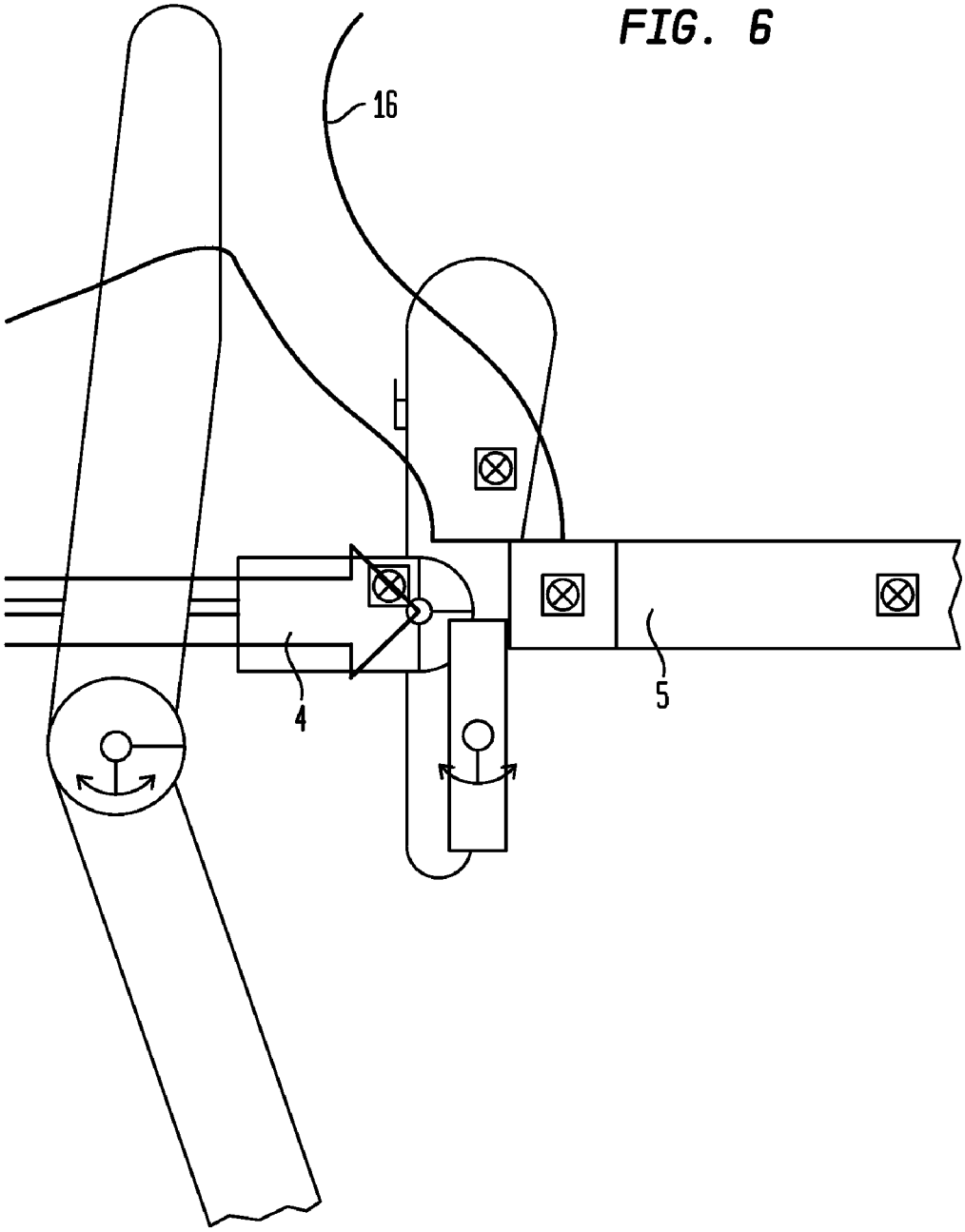
FIG. 6 is close up of the 2D computer simulation showing models of the solenoid and the plunger shown in FIGS. 5A and 5B.

Referring to FIG. 6, a close-up view of a latch actuation system of FIGS. 5A and 5B is illustratively depicted. Solenoid 4 employs plunger 5 to actuate the conductor 13 between the latched and unlatched positions. Greater detail of the latch actuation system will be described below.

Figure 7:
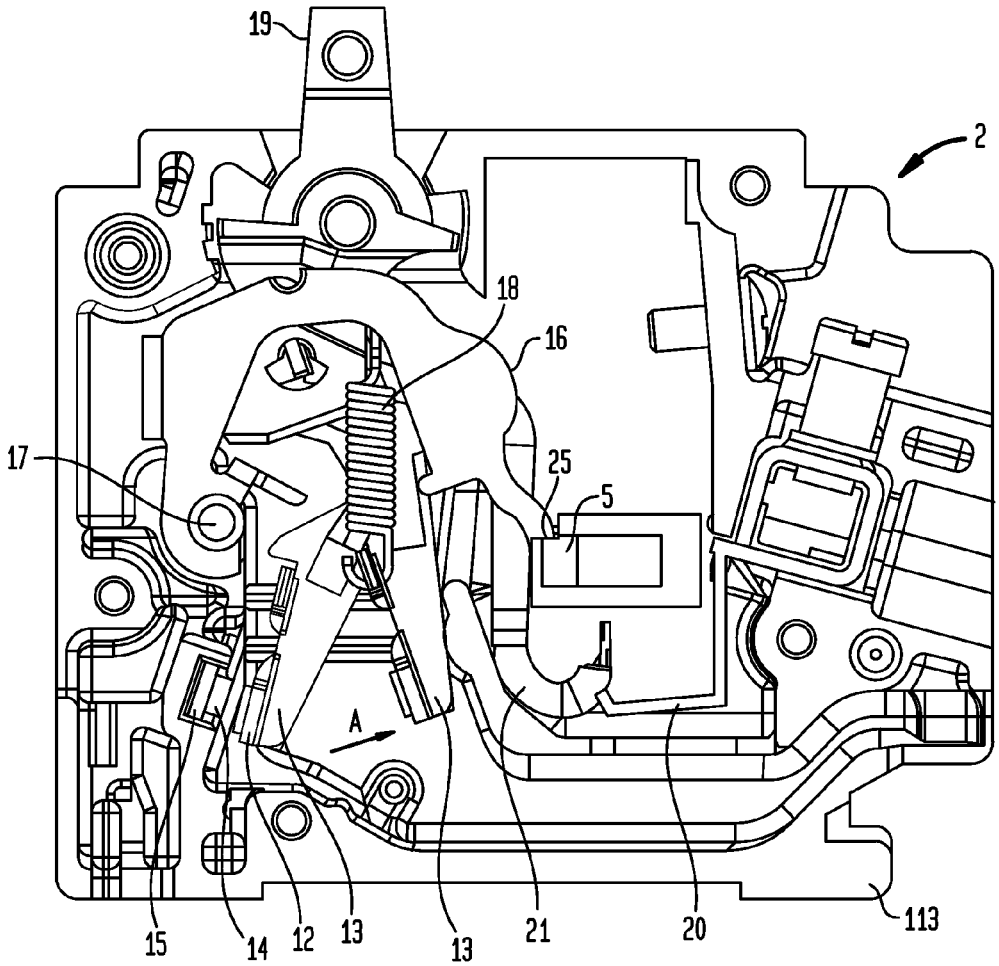
FIG. 7 is a view showing a mechanism pole (showing a mechanical compartment) without bimetal/yoke/armature construction where a moveable bus (13) is depicted in two positions for demonstrative purposes.

Referring to FIG. 7, components of the mechanical compartment 2 of the breaker 100 are illustratively shown. The mechanical pole provided in this embodiment is without an armature, yoke, and bimetal. The mechanism has a moveable contact 12 connected to a moveable bus or pole 13 and a stationary contact 14 connected to a stationary bus 15 (which connects to a wire 112, not shown). The mechanical poles also include an overload and instantaneous operation mechanism. FIG. 7 shows moveable bus 13 in both latched and unlatched positions for simplicity of comparison.

The moveable bus 13 carries a moveable contact 12. The moveable bus 13 is connected to a cradle 16 that pivots about a molded feature 17 in the bottom cover 113. The cradle 16 is connected to the moveable bus 13 by an extension spring 18. An upper end of the moveable bus 13 is connected to a breaker handle 19. To close the contacts, the handle 19 is moved to the on position which rotates the moveable bus 13. To open the contacts 12 and 14, the handle 19 is moved to the off position. This action rotates the moveable bus 13 in the direction of arrow "A" and then separates the contacts 12 and 14, respectively.

The moveable bus 13 is connected to a load terminal 20 by a flexible conductor 21. The latch system of the circuit breaker 100 is triggered when the handle 13 is moved past the off position. As the handle 19 is rotated toward the off position (arrow "A"), the cradle 16 rotates counterclockwise, toward the handle 19. A tip 25 of the cradle 16 passes the plunger 5. The plunger 5 moves toward the cradle 16 by a compression spring 6 (not shown) pushing on the plunger 5. As the breaker handle 19 is rotated to the on position, the cradle 16 rotates in a clockwise direction and engages with the plunger 5. During an overload condition, the solenoid 4 (FIG. 8) is triggered and in turn pushes on the plunger 5 to de-latch the breaker. When a latch surface 25 becomes too small to maintain, the extension spring 18 rotates the moveable bus 13 counterclockwise to separate the moveable contact 12 from the stationary contact 14. During a short circuit, the solenoid 4 would be triggered and de-latch the breaker as well.

Figure 8:
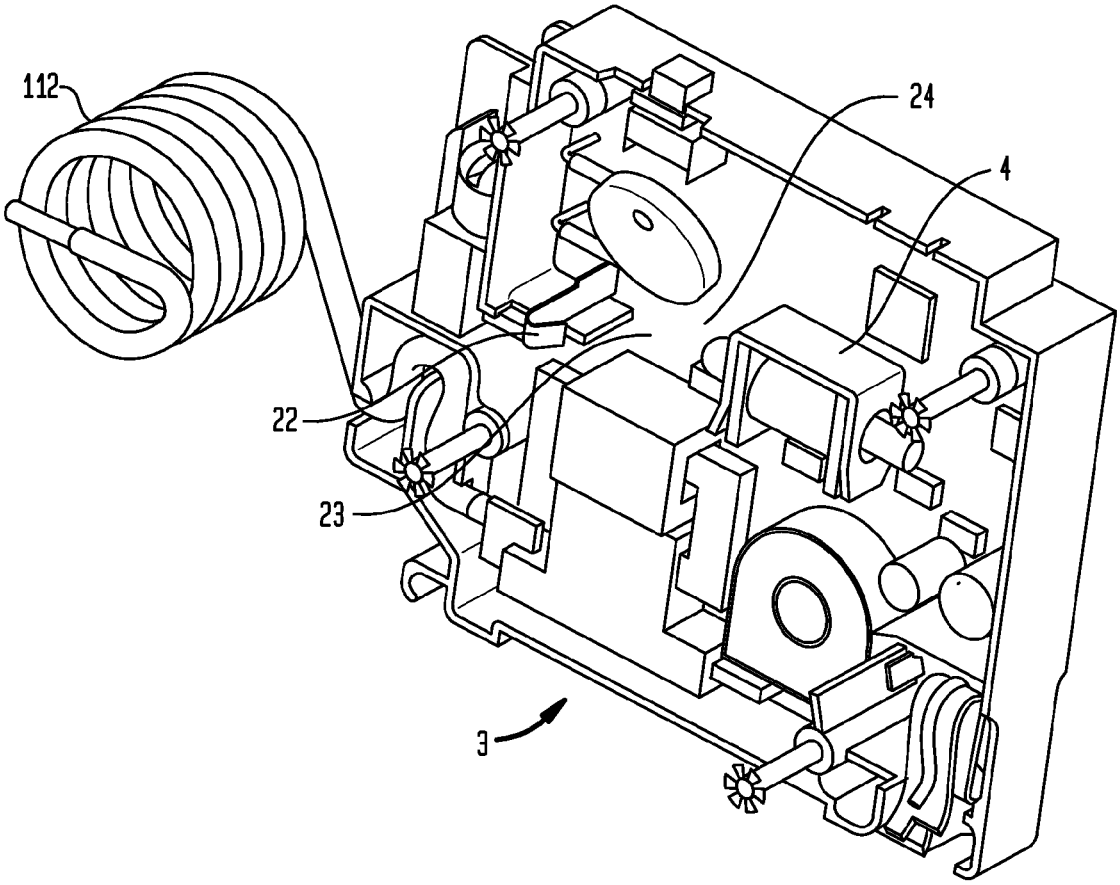
FIG. 8 is a perspective view showing electronic compartment components.

Referring to FIGS. 7 and 8, the breaker (100) includes electronic sensing of electrical conditions and includes an electronic actuator. These features provide an electronic tripping mechanism (e.g., including sensors and the solenoid 4 or other actuation device). This electronic tripping mechanism senses overload conditions and instantaneous surges. In one embodiment, electronic trip circuitry includes a single wound solenoid 4 mounted on a circuit board 23 and is located in the electronic compartment 3. A connector 22 is used to tap into the current flow through the mechanism poles on the load terminal 20 and in turn supplies power to the circuit board 23. A separate power supply may also be employed. A feature located on the plunger 5 from the mechanical pole extends into the electronic compartment 3. The solenoid 4 has a molded insulated piece 24 attached to the tip. When the single wound solenoid 4 is energized, the solenoid 4 extends and begins to push on the plunger 5 towards the cradle 16. Once a latch bite 25 between the cradle 16 and the plunger 5 has decreased, the mechanism is de-latched. The handle 19 is employed to reset the cradle 16 and re-latch the breaker.

Figure 9:
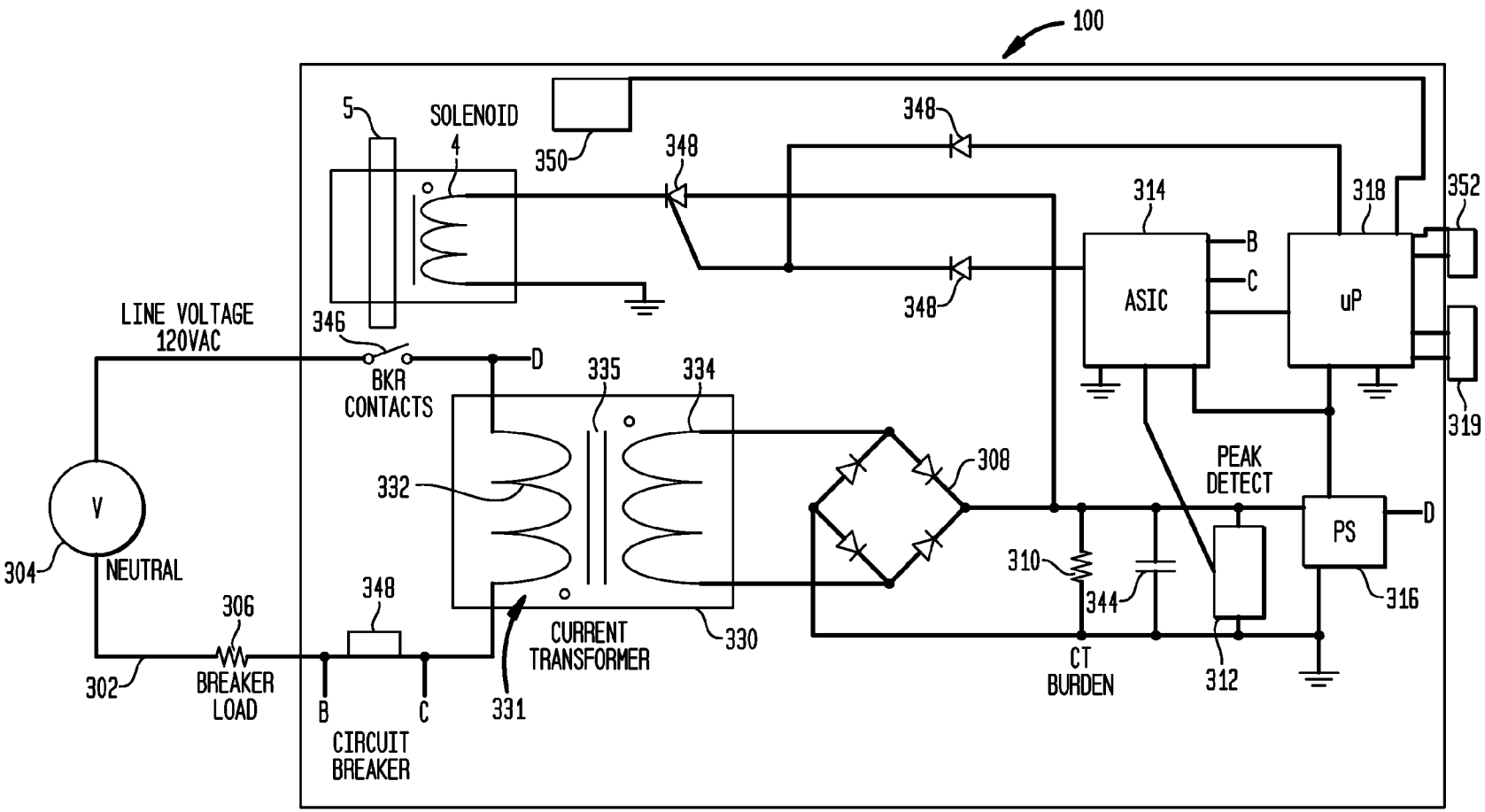
FIG. 9 is a schematic diagram showing electronic circuitry used to monitor overload and instantaneous conditions.

Referring to FIG. 9, a schematic diagram of an illustrative electronic circuit 300 is shown in accordance with one embodiment. The circuit 300 includes a breaker 100 in accordance with the present principles. The breaker 100 connects to a circuit 302 having a voltage 304 and a load 306. The breaker 100 monitors the current in the load of circuit 302. A current sensor 330 includes a current transformer (CT) 331 employed for sensing the current in circuit 302. The current sensor 330 construction includes a primary side coil 332 (H1 turns) placed in series with a load using an internal galvanic connection to a line side and load side bus of the circuit breaker 100. With the exception of the primary coil 332, the sensor 330 is electrically isolated, but magnetically coupled to a secondary high turn coil 334 using a core 335 preferably made from high permeable cold rolled steel.

Figure 10:
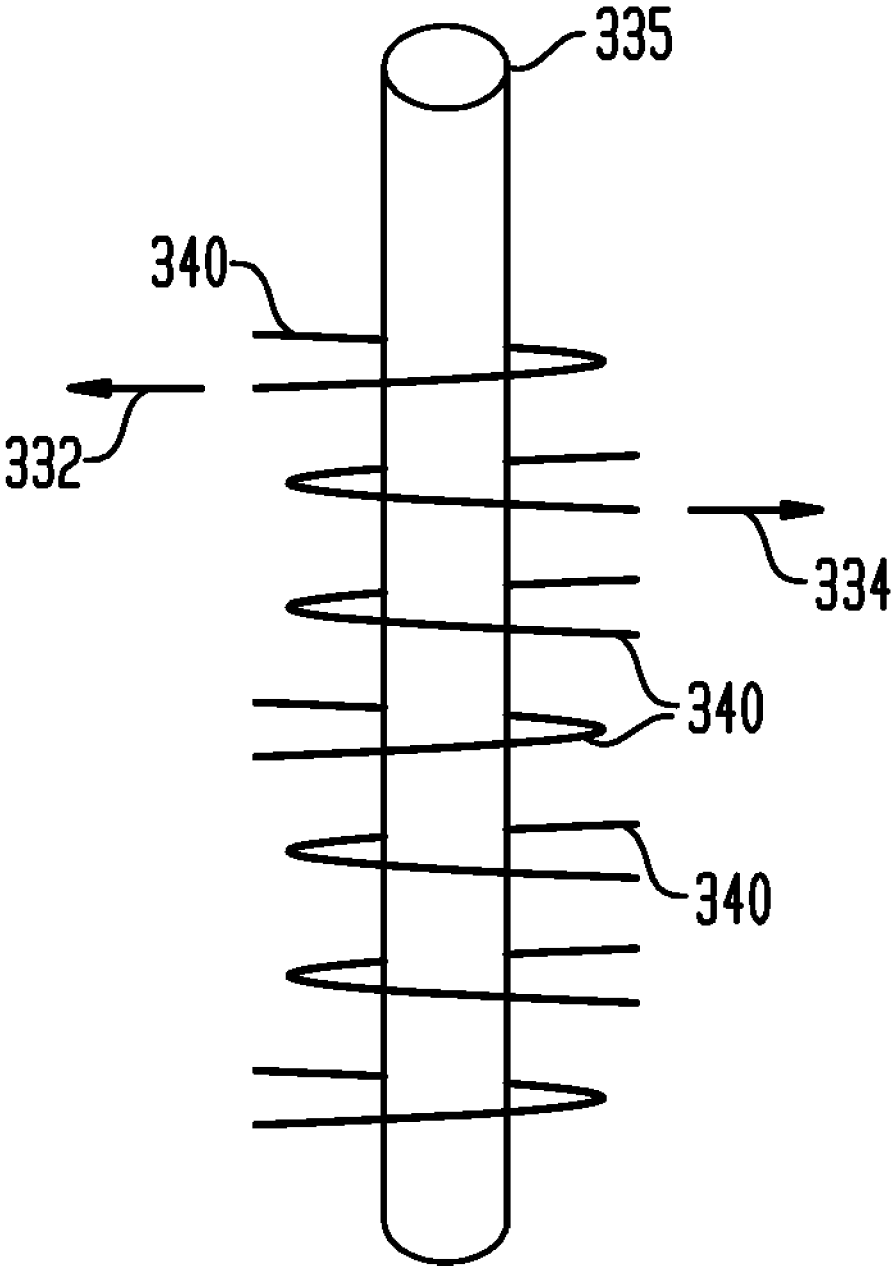
FIG. 10 is a diagram illustratively showing windings of a transformer core.

Referring to FIG. 10, the core or lamination design may be represented by "U" shaped laminations 340 stacked on top of each other in an alternating pattern completing a "0" shape as depicted in FIG. 10. The core chain links the primary coil 332 to the secondary coil 334.

Referring again to FIG. 9, the current sensor 330 represents a reduced output signal of the primary current amplitude of circuit 302. The amplitude is preferably low enough to be measured by discrete bipolar or CMOS electronics and may be packaged using an application specific integrated circuit (ASIC) chip 314. One advantage of using a CT sensor 330 provides that at large currents the CT 330 can be designed to saturate at above 1000% of the handle rating or at any other percentage of the handle rating. The current sensor 330 therefore permits flexibility in adjusting or designing sensitivity of the breaker 100.

Fluctuations output from the current sensor 330 are applied to a diode circuit 308 or other forward biased configuration. The diode circuit 308 provides a voltage across a current a CT burden resistance 310, and assists in rectifying the voltage for powering and interfacing with semiconductor devices. The voltage applied across the burden resistor 310 is employed to monitor the voltage against a threshold. The CT burden 310 of the secondary coil 334 may include a low ohm, low tolerance, high precision resistor to generate a measurable voltage from the secondary coil current which represents a fraction of the primary current. A peak detector 312 reports conditions where surges are in excess of an acceptable level to ASIC 314.

A non-isolated power supply (PS) 316 may be connected to the mains voltage line at D to power the electronics when no load current is present. Power supply 316 provides power to the ASIC 314, the peak detector 312, push to test function 319 and/or to a microprocessor (uP) 318. The current sensor 330, rectifier circuit 308 and resistor 310 may also be used as a secondary isolated power supply during a bolted fault short or when a load is present to draw current for powering the electronics to drive current into a capacitor 344 to be employed as a source.

The power supply 316 may include two independent power supply blocks electrically "ORed" by the microprocessor 318 depending on the presence of load current or no load current. The mains power the non-isolated power supply dependent on the line voltage 304 at D. This may employ a device such as an "Off line switcher IC" capable of handling, e.g., 85 to 265V AC input with an output of, e.g., 12 VDC feeding into a linear regulator chip (not shown) with a 12 to 30V DC input and 3 to 5V DC regulated output for low power CMOS chips.

An isolated power supply (also shown as 316) may also be created using CT 331, rectifier circuit 308, (converting AC to DC), burden resistor 310, and capacitor 344. The power supply 316 is dependent on the attenuated load current and dumps current into capacitor 344 for which the same linear regulator (not shown) could regulate the DC voltage for the CMOS chips. One feature regarding the power supplies may include an optimizing feature of the microprocessor 318 which measures methods the voltage and current to determine which power supply (non-isolating using mains or isolating using rectified voltage) is more efficient to use and switch depending on the voltage/current conditions. Also power, power factor, THD, crest factor, brown out indicator, and other metering and power quality functions could be communicated by the microprocessor 318 once these measurements are taken and stored.

Instantaneous or current levels reaching, for example, 1000% of the handle rating or other adjustable thresholds, are detected using a peak detection resistive network 312 which trips the breaker once these peak levels are reached. In one embodiment, the ASIC 314 monitors the conditions from the peak detector 312. The microprocessor 318 detects overload power conditions and may report these conditions to the ASIC 314 (or vice versa). The ASIC 314 and/or the microprocessor 318 monitor the operating conditions to provide a trip signal to a solenoid 4. The present illustrative configuration may be adjusted to include any number of other detectors such as for example, a heat sensor, a noise detector, a load detector, or any other sensor device. Alternately, the microprocessor 318 may provide its own trip signal for an overload condition. The overload currents detected by the CT sensor 330 are evaluated by methods of the microcontroller 318 in which the microcontroller 318 trips the circuit breaker based on overload currents.

The ASIC 314 and the microcontroller 318 may be combined in a single processing device which may be able to handle multiple inputs and process these signals to create a trip signal for a solenoid 4. For example, a heat sensor 350 (or a noise detector, a load detector, or any other sensor device) may be employed in the breaker 100 to enable additional inputs for determining proper operation of the circuit 302 and/or breaker 100.

Silicon-controlled rectifiers (or semiconductor-controlled rectifiers) (SCR) are solid state devices that control current flow. SCRs or other rectifiers 348 are employed to control current flow to a solenoid 4. The solenoid 4 is electronically activated in accordance with the microcontroller 318, the ASIC 314, both and/or other sensors. Solenoid 4 causes plunger 5 to break contacts 346 in accordance with conditions being monitored. A "magnetic trip" signal or a large in-rush of current is detected using the CT 331 and the contacts 346 are opened to open circuit 302. The contacts are reengaged mechanically by resetting a handle (not shown) for the breaker 100. In one illustrative embodiment, the breaker 100 creates an open within a 4 msec or less time frame.

In one embodiment, an optional shut resistor 348 between a line side and a load side of the circuit breaker 100 can also be employed as the current sensor (instead of or in addition to the current sensor 330) to sense current draw of the load. This series resistor 348 should be very small in resistive magnitude. Measurements of voltage at point B and C are reported from the sensor resistor 348 to the ASIC 314 to sense current in circuit 302.

Other features of the breaker 100 may include an indicator 352 or the like which provides information about the operation of the circuit breaker 100. For example, the indicator 352 may include a light emitting diode which signals that the circuit breaker 100 is in operation (e.g., latched), among other things.

Having described preferred embodiments for a circuit breaker with electronic sensing and de-latch activation (which are intended to be illustrative and not limiting), it is noted that modifications and variations can be made by persons skilled in the art in light of the above teachings. It is therefore to be understood that changes may be made in the particular embodiments of the invention disclosed which are within the scope and spirit of the invention as outlined by the appended claims. Having thus described the invention with the details and particularity required by the patent laws, what is claimed and desired protected by Letters Patent is set forth in the appended claims.

What is claimed is:

1. A circuit breaker, comprising:

a mechanical pole moveable between a latched position and an unlatched position to open an electrical connection between a pair of electrical contacts wherein the mechanical pole is coupled to a cradle which pivots about a pivot point such that, in the latched position, a latch bite portion of the cradle contacts a plunger and is biased by a spring against the plunger; and an electronic tripping device including a solenoid for tripping the mechanical pole, the electronic tripping device configured to sense and respond to at least one sensor signal, the at least one sensor signal being output from at least one condition sensor which detects at least one of an overload condition and an instantaneous condition wherein upon receiving the at least one sensor signal the electronic tripping device activates the solenoid to trip the mechanical pole into the unlatched position wherein during a condition, the cradle is released by the plunger to cause the mechanical pole to break contact between the electrical contacts.

2. The breaker as recited in claim 1, further comprising a housing having two separate and independent subassemblies, the subassemblies including:

a first module including the mechanical pole and the pair of electrical contacts in a first section; and a second module including the electronic tripping device and the at least one condition sensor wherein the subassemblies are fabricated independently of each other.

3. The breaker as recited in claim 2, wherein the first module includes mechanical components and the second module includes electronic components and the subassemblies are separate prior to final assembly.

4. The breaker as recited in claim 1, wherein the circuit breaker includes a two pole device.

5. The breaker as recited in claim 1, wherein the at least one condition sensor includes a current sensor configured to provide a signal operable with semiconductor devices.

6. The breaker as recited in claim 1, wherein the at least one condition sensor includes at least one integrated circuit chip configured to activate the electronic tripping device in response to the at least one condition.

7. The breaker as recited in claim 6, wherein the at least one integrated circuit chip includes at least one of a microprocessor, an application specific integrated circuit and a combination thereof.

8. The breaker as recited in claim 1, wherein the at least one sensor includes a current transformer.

9. The breaker as recited in claim 1, wherein current from the current transformer is employed as a power source.

10. The breaker as recited in claim 1, further comprising a peak detection resistive network configured to indicate when peak levels are reached, wherein the at least one condition includes reaching a peak level.

11. The breaker as recited in claim 1, further comprising a microprocessor configured to indicate when an overload condition exists, wherein the at least one condition includes an overload condition.

12. A circuit breaker, comprising:

a mechanical pole moveable between a latched position and an unlatched position to open an electrical connection between a pair of electrical contacts wherein the mechanical pole is coupled to a cradle which pivots about a pivot point;

an actuator device configured to respond to a sensor signal and move a plunger to release the mechanical pole to the unlatched position in accordance with a biasing device and wherein in the latched position the cradle is oriented such that a latch bite portion of the cradle contacts the plunger and is biased by a spring against the plunger;

at least one sensor configured to monitor conditions of a circuit and to provide the sensor signal; and a trip circuit embodied in an integrated circuit being responsive to the sensor signal when the conditions exceed a threshold indicative of at least one of an overload condition and an instantaneous condition wherein the trip circuit electronically generates a trip signal in accordance with the sensor signal exceeding the threshold to activate the actuator device to move the plunger such that plunger no longer contacts the latch bite portion to release the cradle and trip the mechanical pole into the unlatched position.

13. The breaker as recited in claim 12, wherein the actuator device includes a solenoid employed to trip the mechanical pole to affect the unlatched position.

14. The breaker as recited in claim 12, further comprising a housing having two separate and independent subassemblies, the subassemblies including:

a first module including mechanical components; and a second module including electronic components wherein the subassemblies are fabricated independently of each other and parts of the first module and parts of the second module interconnect and function in a final assembly.

15. The breaker as recited in claim 12, wherein the at least one sensor includes a current sensor configured to provide a signal operable with semiconductor devices; and the trip circuit includes at least one of a microprocessor, an application specific integrated circuit and a combination thereof.

16. The breaker as recited in claim 12, wherein the at least one sensor includes a current transformer and current from the current transformer is employed as a power source.

17. A method for breaking a circuit, comprising:

providing a circuit breaker having a mechanical pole moveable between a latched position and an unlatched position to open an electrical connection between a pair of electrical contacts wherein the mechanical pole is coupled to a cradle which pivots about a pivot point such that, in the latched position, a latch bite portion of the cradle contacts a plunger and is biased by a spring against the plunger;

providing an actuator device for moving the plunger to release the mechanical pole to the unlatched position;

setting the circuit breaker to a latched position to provide a closed circuit loop through the circuit breaker;

monitoring current in the closed circuit loop using an electronic circuit to determine when circuit conditions exceed at least one threshold value indicative of at least one of an overload condition and an instantaneous condition; and tripping the circuit breaker using an electronic signal generated by an integrated circuit chip when the circuit conditions exceed the at least one threshold value to activate the actuator device and move the plunger to release the cradle to cause the mechanical pole to break contact between the electrical contacts.

18. The method as recited in claim 17, further comprising:

fabricating two separate and independent subassemblies, the subassemblies including a first module including mechanical components and a second module including electronic components; and assembling the subassemblies into a final assembly to form the circuit breaker.

19. The method as recited in claim 17, further comprising resetting the circuit breaker.

* * * * *